United States Patent [19]

Garrett

[11] 3,980,135

[45] Sept. 14, 1976

[54] SELF-CONTAINED, RETRIEVABLE VALVING ASSEMBLY

[75] Inventor: Henry U. Garrett, Houston, Tex.

[73] Assignee: Schlumberger Technology Corporation, New York, N.Y.

[22] Filed: Aug. 18, 1971

[21] Appl. No.: 172,750

[52] U.S. Cl. ..... 166/224 A; 137/471; 137/510

[51] Int. Cl.[2] ..... E21B 33/00; E21B 43/00

[58] Field of Search ..... 166/224; 251/58, 59, 251/63; 137/461, 470, 510

[56] References Cited

UNITED STATES PATENTS

| | | | |
|---|---|---|---|
| 3,071,151 | 1/1963 | Sizer | 166/224 |
| 3,452,777 | 6/1969 | Dollison | 137/510 |
| 3,633,670 | 1/1972 | Brown et al. | 166/128 |

*Primary Examiner*—Ernest R. Purser
*Assistant Examiner*—Jack E. Ebel
*Attorney, Agent, or Firm*—David L. Moseley; William R. Sherman; Stewart F. Moore

[57] ABSTRACT

An assembly adapted to be anchored at a subsurface location within a tubular well conduit to function as a self-closing safety valve. The assembly includes a flapper valve closure element pivotably mounted in a tubular valve housing and controlled by a pressure sensitive control mechanism. An anchoring means having radially expansible anchoring and sealing members is employed to secure the valve in place and to form a seal which forces fluid in the conduit to flow through a flow passage in the valve housing. The expansible anchoring and sealing means may be retracted to permit retrieval of the entire assembly. The control mechanism includes a pressure charged bellows chamber which moves in response to a drop in the pressure within the well conduit to cause the flapper to close the flow passage.

An incompressible fluid contained within the bellows of the control mechanism cooperates with a double acting valve to prevent over extension or over compression of the bellows by extremes in pressure differential. The force of a compressed spring is suddenly released by movement of the bellows to produce a short, strong movement which is transmitted to the flapper closure element causing it to snap into closed position.

11 Claims, 10 Drawing Figures

HENRY U. GARRETT
INVENTOR.

BY Carlos A. Torres

ATTORNEY

HENRY U. GARRETT
INVENTOR.

BY

Carlos A. Torres

ATTORNEY

HENRY U. GARRETT
INVENTOR.

BY Carlos A. Torres

SELF-CONTAINED, RETRIEVABLE VALVING ASSEMBLY

BACKGROUND OF THE INVENTION

1. Field of the Invention

The present invention relates to means for controlling fluid flow through a flow conduit. In a specific application, the present invention relates to self-closing safety valves employed in the production tubing of a completed well to prevent uncontrolled fluid flow through the tubing following failure of or damage to the restraining structure at the wellhead.

2. Description of the Prior Art

In many wells producing from a high pressure, subterranean petroleum bearing formation, a self-closing safety valve is positioned in the production string when the well is initially completed to prevent uncontrolled flow through the well in the event the confining or restraining structure at the wellhead should be destroyed or become inoperative. In some cases, however, wells were not equipped with subsurface safety valves when the production tubing was installed and regulatory agencies have required that production from some of these wells be terminated until safety valves are installed.

Where the need for a downhole safety valve is known in advance, a suitable nipple is usually included in the tubing string as the string is initially positioned in the well. Thereafter, a safety valve is lowered into the tubing string and special dogs or other means on the valve spring into receiving grooves or the like formed in the nipple to hold the valve in operative position. In some cases, the wells are initially equipped with non-retrievable, subsurface safety valves which form a part of the tubing string itself. In those systems where the valve is a part of the tubing string itself, inspection, repair or replacement of the valve may often require a complete shut down of production while the tubing string is removed from the well.

Where the tubing string lacks special landing nipples for receiving the required safety valve, it is often necessary to withdraw the tubing string from the well, insert the required nipple and then replace the string. This procedure is undesirable primarily in that it may involve a significant loss in production time.

Conventional safety valves often employ relatively narrow flow passage openings which form a restriction to the flow of fluids through the well conduit. Restricted flow passages are normally undesirable, particularly where the formation pressure is relatively low, since the restriction limits production below that which would otherwise be possible. Small valve openings are also undesirable in that it is difficult or impossible for equipment to be lowered through the valve opening so that testing or other procedures may be conducted below the valve. Another shortcoming associated with restricted valve openings is the tendency of such valves to be cut away by abrasive materials carried in the petroleum fluids flowing through the valve. This is particularly evident where the valve closure surfaces are directly exposed to the fluid flow.

Conventionally, the sensing elements employed to close safety valves have included either flow sensitive or pressure sensitive devices. In these devices, an increase in flow rate or a decrease in pressure respectively indicate uncontrolled well flow which automatically triggers closing of the safety valve. Flow sensing elements are undesirable to the extent that the required flow monitoring element may restrict flow. In marginal wells having a relatively low bottomhole pressure, any restriction to flow can limit production below that which would otherwise be obtainable.

The prior art is replete with bellows driven pressure sensitive controls employed in conjunction with self-operating valving mechanism. In such prior art controls, bellows damage is often encountered because of extreme pressure differentials imposed across the bellow walls causing the bellows to be distorted beyond design limits. Another problem associated with conventional bellows operated controls stems from the fact that relatively slow, low force closing movements obtainable with the bellows may cause partial or improper seating of the valve.

SUMMARY OF THE INVENTION

The self-contained retrievable valving assembly of the present invention includes a retrievable packer, a valving mechanism and a control mechanism. The packer includes radially expansible anchoring means to secure the assembly internally of the well conduit at a subsurface location and expansible packing or sealing means to provide a pressure-proof seal about the packer body. The packer permits the valving assembly to be retrievably positioned within existing production tubing without the need for special landing nipples or other receiving means being inserted into the string before it is run into position. The packer may include either conventional friction slips, or where latching within a collar recess is desired, may include expansible dogs designed to move into and engage with the recess formed between two adjoining tubing lengths.

The assembly is retrievable to permit inspection, replacement, repair or adjustment of both the control mechanism and the valve mechanism without having to remove the tubing string from the well.

The valve mechanism of the assembly is equipped with a relatively large flow passage opening which reduces flow restriction and permits equipment to be moved through the valve. Abrasion and cutting of the valve structure is also reduced because of the relatively large flow passage opening. The valve mechanism is equipped with a low cost, dependable flapper type closure element which pivots out of the flow passage during normal operation to reduce wear on the seating surfaces of the element.

The control mechanism is self-contained and in its preferred form is sensitive to a drop in tubing pressure to automatically close the flapper valve element in the valve mechanism. The control mechanism may be easily removed and replaced and is not an integral portion of the valve mechanism itself. Because it is pressure sensitive, the control mechanism eliminates the need for a flow restrictive monitoring element such as is required in flow sensitive controls. Reopening of the valve is effected by simply pressuring up from the wellhead.

In the preferred form of the invention, the bellows sections in the control mechanism are filled with an incompressible fluid to protect the bellows from distortion caused by high pressure differentials. The fluid acts in conjunction with a double acting valving system so that the bellows sections are protected from damage caused by high pressure exerted either on the inside or the outside of the bellows wall.

The control means also includes a snap action which ensures complete closure of the valve element. Limited travel of the bellows releases the force of compressed spring means to exert a relatively fast, high force movement which is transmitted to the pivoted valve closure member to provide a snap action closure.

The foregoing and other features and advantages of the present invention will be more fully understood from the following specification, claims and the related drawings.

DESCRIPTION OF THE PREFERRED EMBODIMENTS

Figure 1:
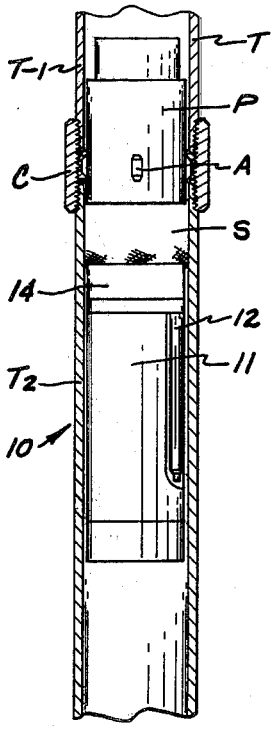
FIG. 1 is a partial, vertical elevation, partially in section illustrating the self-contained retrievable valving assembly of the present invention in position within a production tubing string.

Referring to FIG. 1, the assembly of the present invention is indicated generally at 10 in position within a production tubing string T. The assembly 10 includes a packer P having a sealing means S and anchoring means A. A valve mechanism 11 operated by a control mechanism 12 is secured to the packer P by a connecting sleeve 14.

In the illustration of FIG. 1, the packer anchoring means A are illustrated as expansible dogs which have been radially expanded into the annular collar recess formed between upper and lower tubing sections T-1 and T-2, respectively which are joined together by a conventional collar C. An elastomeric material is employed for the sealing means S so that upon expansion of the sealing means, a pressure seal is formed between the body of the packer P and the surrounding conduit T.

The packer P is of the type which may be set within a tubing string and subsequently retrieved in conventional manner. The packer preferably includes a large central opening to permit relatively unimpeded flow of fluids through the tubing. Where collar recesses are not available, or where otherwise desired, the anchoring dogs A may be replaced by conventional slips having teeth formed along their external surfaces and adapted to be moved radially outwardly into friction locking engagement with the internal walls of the tubing string. The packer P may be similar to the packer described in U.S. patent application Ser. No. 857,047 filed Sept. 11, 1969 entitled ANCHOR ASSEMBLY FOR WELL TOOLS SUCH AS PACKERS AND THE LIKE, or U.S. patent application Ser. No. 272 filed Jan. 2, 1970 entitled TOOL STRING ASSEMBLY FOR USE IN WELLS.

Figure 2:
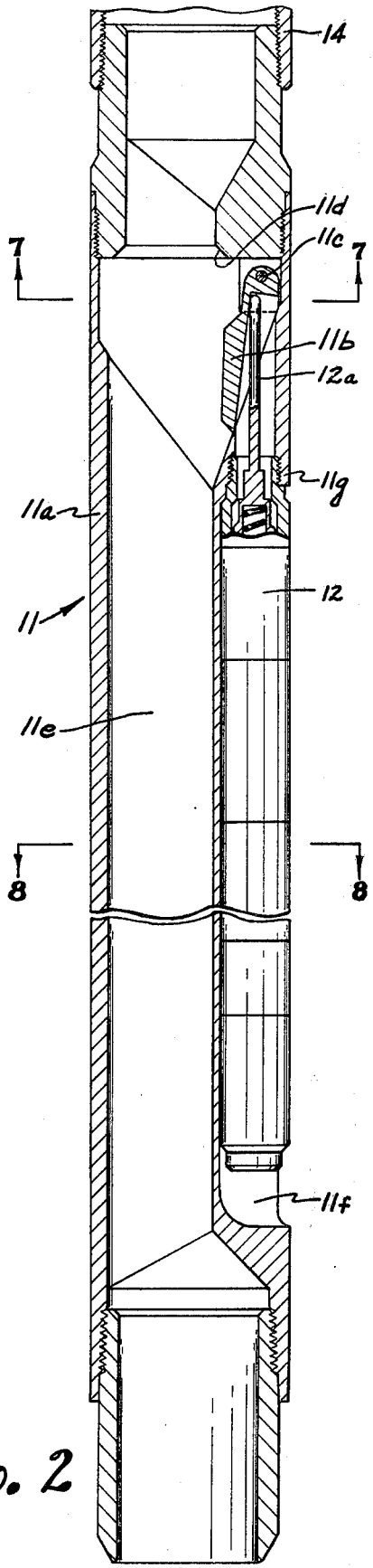
FIG. 2 is an enlarged scale, vertical elevation, partially in section illustrating the preferred form of the valve and control mechanisms in open position.
Figure 3:
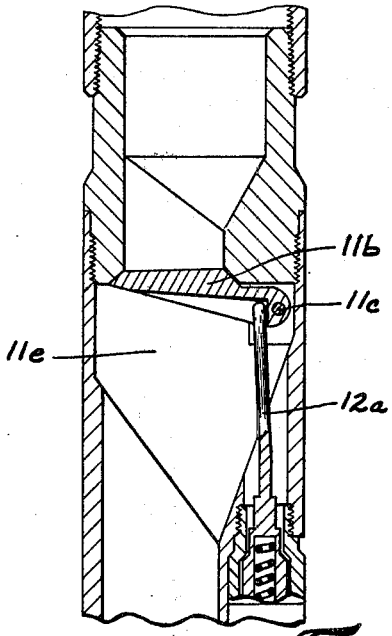
FIG. 3 is a partial, vertical elevation, partially in section illustrating the valve of FIG. 2 in closed position.

As may best be seen by reference to FIG. 2, the valve mechanism 11 includes a tubular housing section 11*a* which surrounds flapper type valve closure member 11*b* adapted to be pivoted about a mounting pin 11*c*. When in closed position, as illustrated in FIG. 3, the valve closure member 11*b* engages and seals with an annular seat 11*d* formed about a flow passage 11*e* which extends through the valve housing 11*a*. When the assembly 10 is anchored in position within a well bore with the seal S expanded to provide the desired pressure seal, well effluents are forced to flow through the flow passage 11*e* and up through the central opening in the packer P.

Figure 8:
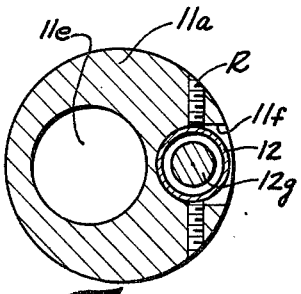
FIG. 8 is a horizontal cross-sectional view taken along the line 8—8 of FIG. 2.
Figure 7:
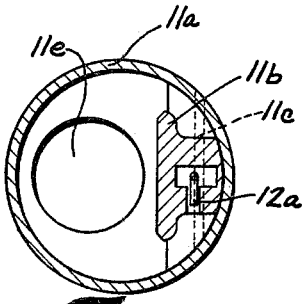
FIG. 7 is a horizontal cross-sectional view taken along the line 7—7 of FIG. 2.

Referring jointly to FIGS. 2 and 8, it may be seen that the control mechanism 12 is received in a semicircular recess 11*f* formed in the external body of the valve housing 11*a*. As illustrated in FIGS. 7 and 8, the composite cross-sectional area of the assembly is substantially circular in shape. The control mechanism 12 is threadably secured to the valve housing 11*a* as illustrated at 11*g* in FIG. 2 and is supported in the recess 11*f* by support bolts R illustrated in FIG. 8. Proper spacing of the control 12 with respect to the flapper valve member 11*b* is effected by changing the threaded engagement 11*g* between the control and the housing 11*a*. Once properly adjusted, the control is held in position by the bolts R. Linear movement exerted by components contained within the control mechanism 12 is conveyed to the flapper closure element 11*b* through a shaft extending from a connecting linkage 12*a* which projects from the control mechanism into the valve mechanism. The linkage 12*a* includes a flexible shaft portion at its upper end and an enlarged tubular body section at its lower end. FIG. 7 of the drawings illustrates the separable connection formed between the upper end of the linkage 12*a* and the closure element 11*b* which permits separation of the two structures when the control mechanism 12 is removed from the valve mechanism 11. The upper tip of the linkage 12*a* is bent at a right angle to the main shaft and is loosely received in a lateral bore formed in the flapper element 11*b*. As the valve element rotates about the mounting pin 11*c*, the receiving bore moves in an arc and rotates about the tip of the linkage 12*a*. It will be appreciated that movement of the linkage 12*a* toward the pin 11*c* pivots the valve element 11*b* toward its closed position while movement away from the pin pivots the element to its open position. As best illustrated in FIG. 3, the pivotal movement of the flapper closure element 11*b* is accommodated in the linearly moving linkage 12*a* by flexing of the linkage's main shaft portion.

Details in the preferred form of the control mechanism 12 may best be described with reference to FIG. 4 where it is seen that a plural part, tubular housing 12*b* encases the components of the control 12. Internal components of the control include upper and lower bellows sections 12*c* and 12*d*, respectively. The bellows sections are of a conventional type adapted to axially elongate or contract in response to pressure differentials existing across the bellows wall. The upper bellows section is secured to the housing at 12*e* and the lower bellows section is secured to the housing at 12*f*. The free end of the bellows section 12*c* is connected to a central driving rod 12*g* while the free end of bellows section 12*d* is connected to a cap 12*h* equipped with a removable plug 12*i*.

The lower end of housing 12*b* is equipped with a removable cap 12*j* which is threadedly engaged to the control housing. Annular O-ring seals 12k are positioned between the cap 12*j* and housing 12*b* to provide a pressure tight seal. A conventional valve 12*j'* is positioned internally of the housing to provide a means for inserting gas into a pressure tight dome or chamber 12*m* formed between the bellows section 12*d* and the internal walls of the control housing 12*b*.

An internal shoulder provided by a component part 12*b'* of the control housing 12*b* supports the lower end of a coil spring 12*n*. A portion of the spring 12*n* extends upwardly within a depending sleeve carried by an axially movable valving component 12*p* and the uppermost end of the spring engages and bears against the body of the valving component 12*p* to bias the component upwardly. An annular, resilient sealing member 12*p'* is carried on the valving component 12*p*. In the lowermost axial position of component 12*p* illustrated in FIG. 4, the seal 12*p'* engages and seals with an internal seating surface 12*b''* to isolate an enclosed area 12*d'* below the seal from an enclosed area 12*c'* above the seal. The upper end of valving component 12*p* includes a sleeve which extends over the lower end of driving rod 12g. Upward movement of component 12*p* is transmitted to the drive rod 12*g* by engagement of shoulders formed on each of the two components. The component 12*p* engages the drive rod 12*g* in a free sliding fit whereby the valving component 12*p* and rod 12*g* may move in opposite directions under certain circumstances to be hereafter described.

Drive rod 12*g* is a plural part component which includes a shoulder section 12*g'* projecting radially away from the main body of the drive rod. A coil spring 12*q* is confined between the shoulder section 12*g'* and an internal shoulder formed within the housing 12*b*. A second coil spring 12*r* is confined between the shoulder section 12*g'* and a shoulder 12*a'* formed on the movable linkage 12*a*. A second shoulder 12*a''* formed on the linkage 12*a* supports the base of a coil spring 12*s* and the upper end of spring 12*s* engages an annular, radially extending shoulder 12*g''*. A triggering member 12*t* having an annular recess 12*t'* formed about its central portion is supported on top of the drive rod 12*g*. Between the upper end of member 12*t* and the linkage 12*a* is confined a power spring 12*u*. A plurality of small metal balls 12*v* are carried in radial bores 12*w* extending through the tubular body section of linkage 12*a*. As will be seen, the balls 12*v* are retained in a radially extended position when illustrated trigger component 12*t* is in the position illustrared in FIG. 4. When in a radially extended position, the balls 12*v* engage upper and lower shoulders formed in the internal surfaces of the housing 12*b* as illustrated in FIG. 4 to prevent axial movement of the linkage 12*a*. When the triggering component 12*t* moves axially upwardly so that the recess 12*t'* is coincident with the balls 12*v*, the balls are permitted to retract radially inwardly and axial movement of the linkage 12*a* is then permitted.

In employing the self-contained, retrievable valving assembly of the present invention, the assembly is initially lowered into the well conduit T by means of a suitable wireline string or other apparatus until the desired subsurface location is reached. The slips or anchoring means A and the seal S are thereafter set and the positioning means is removed from the tubing string. Prior to positioning the assembly within the string T, the chamber 12m is filled with a compressible gas at a desired pressure. The gas pressure in the chamber is determined by the well conditions which are to be encountered by the assembly.

Figure 5:
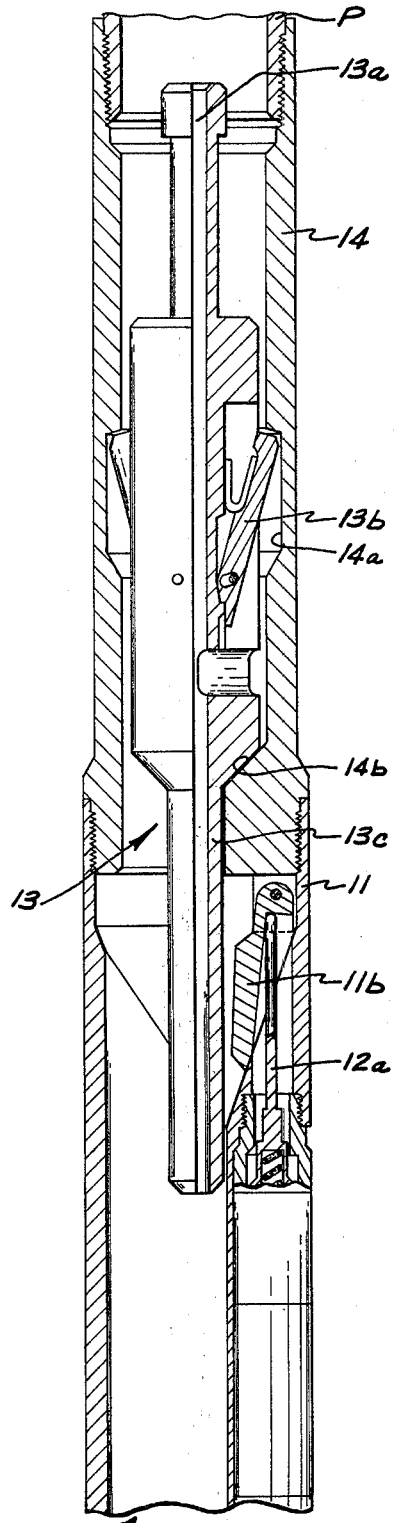
FIG. 5 is a vertical elevation, partially in section, illustrating a device for holding the closure element of the valve mechanism open.

During the lowering procedure, the valve closure member 11*b* is retained in an open position by a hold open mechanism indicated generally at 13 in FIG. 5. The mechanism 13 includes a central bore 13*a* extending axially through the mechanism to permit flow through the assembly as the assembly is being lowered into a fluid containing tubing string. During the downward movement of the member 13 through the tubing string, the dogs 13*b* are depressed radially inwardly and spring out when they are coincident with the recess 14*a*. The lower movement of member 13 is limited by its engagement with a shoulder 14*b* formed internally of the sleeve 14. The lower end of member 13 includes a downwardly extending projection 13*c* which prevents the flapper valve 11*b* from moving into closed position. Once the assembly has been properly positioned within the tubing string T, the member 13 may be removed by a suitable retrieving means of conventional construction. Removal of the member 13 is effected with back pressure existing at the well head so that the flapper valve 11*b* remains in its open position even with the member 13 removed. The mechanism 13 may also be employed to remove the self-contained assembly 10 from the tubing string T.

When the assembly 10 is in position within the tubing string T, well pressures above a predetermined minimum valve act against the external surface of bellows section 12*c* tending to compress or axially foreshorten the bellows which in turn retains the drive rod 12*g* in its lowermost axial position. In the event unusually high pressures in the tubing string T are encountered, damage to bellows sections 12*c* and 12*d* is prevented by action of the sealing component 12*b'* which prevents the pressure acting against the bellows 12*c* from being communicated to the internal bellows area 12*d'*. Since the internal bellows area 12*c'* and 12*d'* and the area confined between the two sections are completely filled with an incompressible fluid, foreshortening of the bellows section 12*c* is limited to prevent the bellows from collapsing. In the reverse situation where an unusually low pressure acts against the external surface of bellows 12*c*, the pressure charge in the gas chamber 12*m* tends to compress and axially foreshorten the bellows 12*d* which in turn causes the valving component 12*p* to move to its axially upper position where the sealing means 12*p'* is engaged with the seat 12*b'''*. The fluid confined internally of the bellows chamber area 12*d'* prevents the bellows from collapsing and the valving action of component 12*p* prevents the pressure in chamber 12*d'* from being communicated to the bellows chamber 12*c'* so that the bellows section 12*c* is not distorted in an outward direction.

Figure 4:
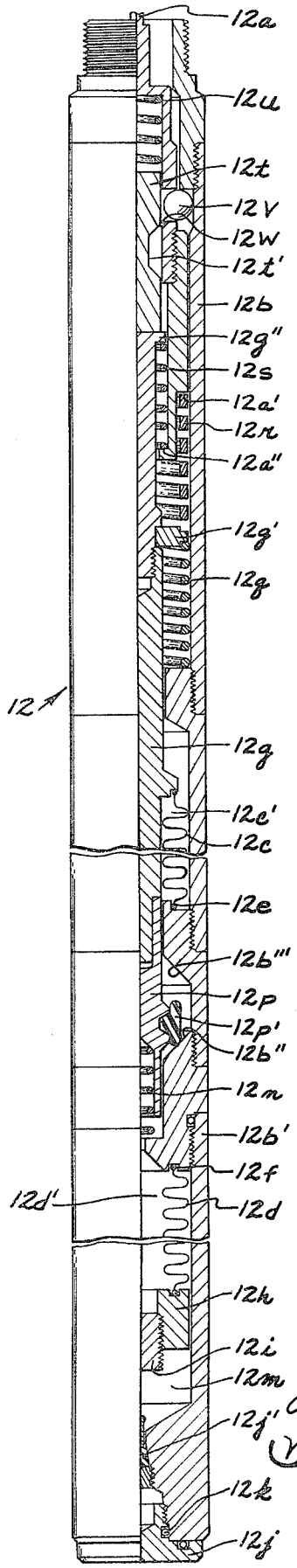
FIG. 4 is an enlarged scale, vertical elevation in quarter-section illustrating details in the construction of the preferred form of the control mechanism.

FIG. 4 illustrates the control mechanism as it appears under normal operating conditions with the valve open. When the pressure of the tubing string drops below a predetermined minimum value, the gas charge in chamber 12*m* exerts a compressing force on the fluid contained in chamber 12*d'* which is transmitted to the fluid in chamber 12c'. The bellows section 12d thus compresses and bellows section 12c expands. During this process, the seal 12p is moved upwardly and when it moves sufficiently upwardly, it engages and seals against the internal seating surface 12b''', to provide bellows protection. The spring 12n forces the valving component 12p to follow the upward movement of drive rod 12g. Because of the slip joint connection between the drive rod 12g and component 12p, the biasing force of spring 12n is required to cause the element 12p to follow the movement of rod 12g. The slip joint connection between rod 12g and element 12p is required because the fluid contained within the chamber sections is not absolutely incompressible and high pressure acting externally of the bellows 12c may tend to push the drive rod 12g slightly upwardly while the valving component 12p is held tightly in sealing position against seat 12b'''. The slip joint permits this small relative movement to take place.

During the upward movement of the drive rod 12g, the springs 12r and 12u are being compressed. When the recess 12t' on member 12t moves up to the balls 12v, the balls can back into the recess and the linking assembly 12a is freed from locking engagement with the housing 12b. The compressed force of spring 12r is then suddenly released to push the linkage 12a quickly upwardly causing the flapper valve 11b to snap shut. The spring 12u also reacts against the top of the element 12t to assist in the snapping action.. During closure of the valve and movement of the linkage 12a upwardly, the spring 12s is compressed by the movement of the linkage shoulder 12a'' toward rod shoulder 12g''. Spring 12s stays highly compressed as long as the valve is closed. When pressure across the closed valve is equalized by pressuring up at the surface, the resilient force of spring 12s tends to drive the linking assembly 12a back downwardly and the rod 12g upwardly. This pulls the linking assembly 12a downwardly through the housing 12b and the spring 12u acts downwardly on the member 12t so that the balls 12v are pushed out of the recess 12t' and into the bore 12w with the member 12t then moving further downwardly under the influence of spring 12u until the valve is again in the position illustrated in FIG. 4.

Figure 6A:
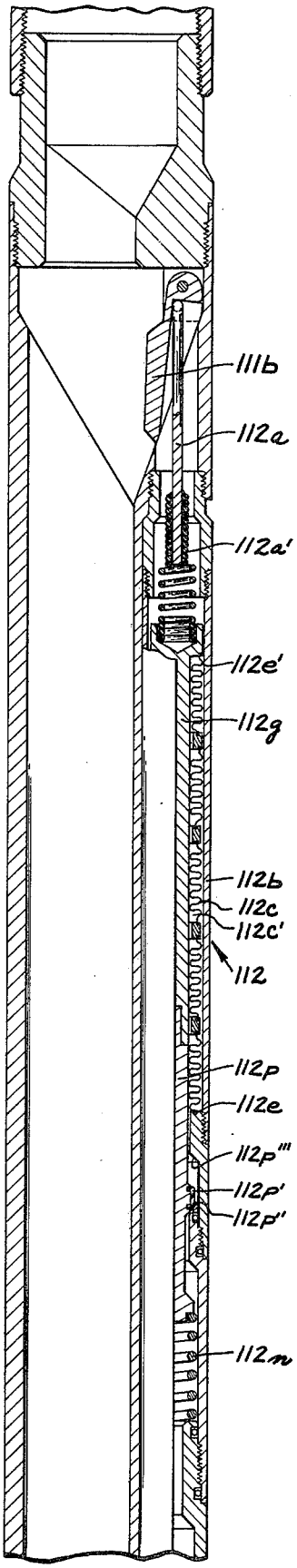
FIGS. 6A and 6B are the upper and lower portions respectively of a modified form of the assembly of the present invention illustrated in vertical section.
Figure 9:
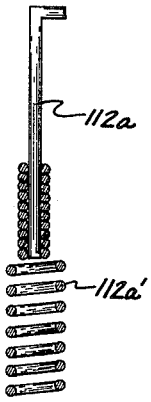
FIG. 9 is a detailed view of a flexible linking mechanism employed to transmit linear motion in the control mechanism to pivotal motion in the valve closure element.
Figure 6B:
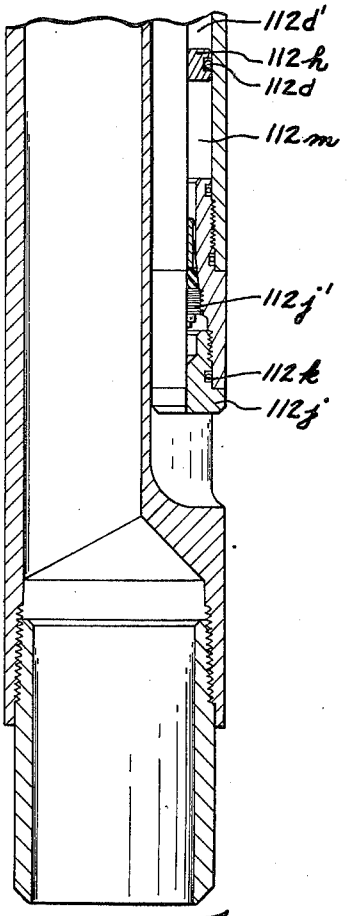

A modified control mechanism indicated generally at 112 is illustrated in FIGS. 6A and 6B. The modified control mechanism 112 includes a spring mounted, flexible linkage 112a carried within a spring mount 112a'. The spring mount 112a' is carried in a recess formed at the upper end of a drive rod 112g. The lower end of the drive rod is telescoped over a valving component 112p equipped with an annular resilient sealing means 112p'. The sealing element 112p' is designed to move between lower and upper sealing surfaces 112p'' and 112p''', respectively formed within the internal walls of a tubular control housing 112b. A coil spring 112n extends between the lower end of the valving component 112p and an internal shoulder formed within the control housing 112b to cause the component 112p to follow upward movement of the rod 112g.

The lower end of the control 112, as illustrated in FIG. 6B, includes a removable cap 112j, an annular sealing O-ring 112k and a conventional gas valve 112j'. With the cap 112j removed, gas is vented through the valve 112j' into a pressure dome 112m contained within the tubular control housing 112b. The bellows portion of the control mechanism 112 includes a single bellows section 112c having its lower end 112e secured to the control housing 112b and its upper end 112e' secured to the drive rod 112g.

A piston /12h equipped with an annular O-ring seal 112d is adapted to move axially through a receiving piston bore in the housing 112b to provide substantially the same function as the bellows 12d employed in the preferred form of the control shown in FIG. 4. The enclosed areas 112d' and 112c' are filled with a non-compressible fluid to provide protection for the bellows 112c in a manner similar to that already described with reference to FIG. 4.

The linking means 112a is designed to transmit the linear motion induced by expansion and contraction of the bellows 112c and travel of the piston 112h to a flapper valve element 111b. The resilient mounting of the linkage 112a in the spring 112a' permits the linkage to flex and bend at its upper end to follow the pivotal movement of the flapper valve 111b during its opening and closing motion.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. A self-contained retrievable valving assembly comprising:

a. retrievable securing means for releasably securing said valving assembly within a tubular well conduit at a subsurface location;

b. valving means connected with said securing means and being operable to regulate the flow of fluid through said tubular well conduit, said valving means including:

i. conduit seal means for forming a sealing engagement with said well conduit;

ii. a substantially tubular valve housing body adapted to be anchored at a subsurface location substantially concentrically within said well conduit;

iii. an axially developed flow passage extending through said tubular valve housing body;

iv. first sealing means included with said flow passage and having a sealing surface extending about said flow passage;

v. a movable closure element mounted for movement with respect to said first sealing means to open or close said housing flow passage, said closure element including a flapper valve means pivotally mounted in said housing body for movement into and out of sealing engagement with said sealing surface for closing or opening said flow passage to fluid flow;

vi. control means connected with said valving means and said securing means for controlling operation of said valving means;

vii. connecting means, including resilient, flexible transfer means for transferring linear motion in said control means to pivotal motion in said flapper valve means, for linking said closure element and said control means whereby said control means governs movement of said closure element to regulate operation of said valving means; and viii. snap acting means for snapping said flapper means from open to closed position.

2. A self-contained retrievable valving assembly comprising:

a. retrievable securing means for releasably securing said valving assembly within a tubular well conduit at a subsurface location;

b. valving means connected with said securing means and being operable to regulate the flow of fluid through said tubular well conduit, said valving means including:

i. conduit seal means for forming a sealing engagement with said well conduit;

ii. a substantially tubular valve housing body adapted to be anchored at a subsurface location substantially concentrically within said well conduit;

iii. an axially developed flow passage extending through said tubular valve housing body;

iv. first sealing means included with said flow passage and having a sealing surface extending about said flow passage;

v. a movable closure element mounted for movement with respect to said first sealing means to open or close said housing flow passage, said closure element including a flapper valve means pivotally mounted in said housing body for movement into and out of sealing engagement with said sealing surface for closing or opening said flow passage to fluid flow;

vi. control means connected with said valving means and said securing means for controlling operation of said valving means; and vii. connecting means linking said closure element and said control means whereby said control means governs movement of said closure element to regulate operation of said valving means, said connecting means including flexible, resilient transfer means for transferring linear motion in said control means to pivotal motion in said flapper valve means.

3. A self-contained, retrievable valving assembly as defined in claim 2 wherein said control means includes pressure charged, expansible bellows means connected with said connecting means whereby expansion or contraction of said bellows means causes said closure element to move to closed or open position.

4. A self-contained, retrievable valving assembly comprising:

a. retrievable securing means for releasably securing said valving within a tubular well conduit at a subsurface location;

b. valving means connected with said securing means and being operable to regulate the flow of fluid through said tubular well conduit, said valving means including:

i. conduit seal means for forming a sealing engagement with said well conduit;

ii. a substantially tubular valve housing body adapted to be anchored at a subsurface location substantially concentrically within said well conduit;

iii. an axially developed flow passage means extending through said tubular valve housing;

first sealing means included with said flow passage;

v. a movable closure element mounted for movement with respect to said first sealing means to open or close said housing flow passage;

c. control means connected with said valving means and said securing means for controlling operation of said valving means; and d. connecting means linking said closure element and said control means whereby said control means governs movement of said closure element to regulate operation of said valving means, said control means including:

i. contractible and expansible bellows means for forming a pressure seal between first and second pressure areas;

ii. first chamber means cooperating with said bellows means to form confining boundaries about said first pressure area;

iii. compressed spring means connected with said movable closure element;

iv. bellows protection means including a noncompressible fluid and a selectively closable safety seal means operable by motion of said bellows means to seal a portion of said fluid in a chamber means formed in part by said bellows means whereby said bellows means is prevented from moving beyond a predetermined maximum amount; and v. release means for releasing said compressed spring means when movement of said bellows means exceeds a predetermined amount to thereby produce a fast, powering movement of said closure element to closed position.

5. A valving assembly as defined in claim 1 wherein:

a. said bellows protection means includes first and second, enclosed bellows sections connected through said safety seal means;

b. said noncompressible fluid is contained in said first and second valving sections; and c. said valving means is operable by movement of said bellows means to seal either said first or second bellows sections whereby fluid in the unsealed section is isolated from the fluid in the sealed section to prevent expansion of the bellows means in said sealed section beyond a predetermined maximum amount.

6. A self-contained retrievable valving assembly for the subsurface control of fluid flow through a tubular well conduit comprising:

a. retrievable securing means for releasably securing said valving assembly at a subsurface location within said tubular well conduit;

b. valving means connected with said securing means and being operable to regulate the flow of fluid through said tubular well conduit, said valving means including:

i. conduit seal means for forming a sealing engagement said valving assembly and said well conduit;

ii. a substantially tubular valve housing body adapted to be anchored substantially concentrically within said well conduit;

iii. an axially developed flow passage means extending through said tubular valve housing;

iv. first sealing means included with said flow passage;

v. a movable closure element mounted for movement with respect to said first sealing means to regulate flow through said flow passage;

vi. control means connected with said valving means and said securing means for controlling operation of said valving means, said control means being positively separated from and disposed eccentrically relative to said flow passage; and vii. connecting means linking said closure element and said control means whereby said control means governs movement of said closure element to regulate operation of said valving means.

7. A self-contained retrievable valving assembly as defined in claim 6 wherein said movable closure element includes a flapper valve pivotally mounted in said housing for movement into and out of sealing engagement with said first sealing means for closing or opening said flow passage to fluid flow.

8. A self-contained, retrievable valving assembly as defined in claim 7 wherein said control means includes pressure charged, expansible bellows means connected with said connecting means whereby expansion or contraction of said bellows means causes the closure element to move to closed or open position.

9. A self-contained, retrievable valving assembly as defined in claim 8 wherein said connecting means includes resilient, flexible transfer means for transferring linear motion in said control means to pivotal motion in said flapper valve means.

10. A self-contained, retrievable valving assembly as defined in claim 9 wherein said control means includes:

a. contractable and expansible bellows means for forming a pressure seal between first and second bellows pressure areas;

b. first chamber means cooperating with said bellows means to form confining boundaries about said first pressure area;

c. compressable spring means operably connected with said movable closure element, said spring means being movable between compressed and expanded positions when said closure element is respectively opened and closed;

d. bellows protection means including a non-compressible fluid and a selectively closable safety seal means operable by motion of said bellows means to seal a portion of said fluid in a chamber means formed in part by said bellows means whereby said bellows means is prevented from moving beyond a predetermined maximum amount; and e. release means for release of said compressed spring means when movement of said bellows means exceeds a predetermined amount to thereby produce a fast, powering movement of said movable closure element to closed position.

11. A self-contained valving assembly as defined in claim 10 wherein:

a. said bellows protection means includes first and second, enclosed bellows sections connected through said safety seal means;

b. said noncompressible fluid is contained in said first and second bellows sections; and c. said valving means is operable by movement of said bellows means to seal either said first or said second bellows sections whereby fluid in the unsealed section is isolated from the fluids in the sealed section to prevent expansion of the bellows means in said sealed section beyond a predetermined maximum amount.

* * * * *